US007121890B2

(12) United States Patent
Chang

(10) Patent No.: US 7,121,890 B2
(45) Date of Patent: Oct. 17, 2006

(54) CABLE CONNECTOR WITH A GROUNDING CLIPPING PORTION

(75) Inventor: Che-Chia Chang, Taipei Hsien (TW)

(73) Assignee: Comax Technology Inc., Taipei Hsien (TW)

( * ) Notice: Subject to any disclaimer, the term of this patent is extended or adjusted under 35 U.S.C. 154(b) by 0 days.

(21) Appl. No.: 11/255,962

(22) Filed: Oct. 24, 2005

(65) Prior Publication Data

US 2006/0199434 A1 Sep. 7, 2006

(30) Foreign Application Priority Data

Mar. 4, 2005 (TW) ..... 94106716

(51) Int. Cl.
*H01R 9/03* (2006.01)

(52) U.S. Cl. ..... 439/610; 439/494

(58) Field of Classification Search ..... 439/608, 439/610, 494, 497
See application file for complete search history.

(56) References Cited

U.S. PATENT DOCUMENTS 6,162,086 A * 12/2000 Kuo ..... 439/497
6,336,827 B1 * 1/2002 Akama et al. ..... 439/610
6,663,428 B1 * 12/2003 Wu ..... 439/608
6,685,501 B1 * 2/2004 Wu et al. ..... 439/497
6,739,904 B1 * 5/2004 Wu ..... 439/497

* cited by examiner

*Primary Examiner*—Hae Moon Hyeon
(74) *Attorney, Agent, or Firm*—Troxell Law Office, PLLC

(57) ABSTRACT

A cable connector comprises a circuit board and a cable. The circuit board comprises a plurality of parallel and separated first and second conductive paths with a ground area alternatively arranged between on either surface. The cable comprises a plurality of transmission channels electrically connecting to the first and second conductive paths. The intervals of the transmission channels of the cable are respectively equal to the intervals of the conductive paths, thus providing better matching impedance and efficiency.

11 Claims, 5 Drawing Sheets

CABLE CONNECTOR WITH A GROUNDING CLIPPING PORTION

REARGROUND OF THE INVENTION

1. Field of the Invention

The present invention relates to a cable connector, more particularly, it relates to a cable connector with high transmission efficiency.

2. Description of the Related Art

As technology improves, the storage products such as hard disks and Universal Serial Bus (USB) flash memory storage devices must provide smaller profile and larger capacity. The interface transmission rate must be correspondingly enhanced as the capacity of the storage devices is increased. Impedance matching and electromagnetic interference problems, however, are getting worse and need to be solved when the interface transmission rate has been raised. Generally, the Serial ATA (SATA) transmission interface has the highest bandwidth among other computer interior transmission interface. Two conductive lines forming a transmission channel and transmitting differential Non-Return to Zero (NRZ) encoding signals are utilized in the Serial ATA. Furthermore, the lengths of the conductive line in each transmission channel must be equal, or the synchronous output signals cannot be received simultaneously, thus causing data errors.

FIG. 1 is a schematic view of a connecting end of a conventional cable connector 1. In FIG. 1, the cable connector 1 includes two line units 11 with a plurality of wires 12 and a housing 13 with conductive terminals 14 therein. During manufacturing, the wires 12 must be manually spread and sequentially soldered on the conductive terminals 11. The lengths of the wires are different and require accurate design to eliminate data errors caused by impedance mismatching and signal asynchronous. Furthermore, while the size and specification of the cable connector 1 are changed, it requires to design again, thus increasing cost and manufacturing yield thereof.

SUMMARY OF THE INVENTION

According to one aspect of the present invention, the present invention provides a cable connector, which is capable of high transmission rate and can be manufactured more effectively.

Another aspect of the present invention is to provide a cable connector, which has high competitiveness and high reliability.

In order to achieve the aforementioned objects, the cable connector comprises a circuit board having a plurality of parallel first signal paths and second signal paths symmetrically positioned on both sides thereof and a cable having a plurality of parallel transmission channels. The gaps between the transmission channels are corresponding to the gaps between the first signal paths and the gaps between second signal paths. Each transmission channel is electrically coupled to the first signal paths and second signal paths, respectively.

Each transmission channel comprises a pair of independent signal lines with a conductive layer covered thereon respectively coupled to one of the first and second signal paths to transfer differential NRZ signals. The circuit board of the embodiment comprises a grounding area with a plurality of grounding paths extended to the portions between each two signal paths. The cable connector further comprises a ground shielding unit covered outside the transmission channels and electrically coupled to the grounding area of the circuit board.

The cable connector comprises a plurality of conductive terminal pairs and grounding terminals. The conductive terminal pairs are electrically coupled to the first signal paths and second signal paths. Each grounding terminal comprises a second clipping portion clamping the printed circuit board and electrically coupled to the grounding area of the circuit board.

The cable connector further comprises a terminal positioning portion with a plurality of first terminal holes and second terminal holes, and the conductive terminal pairs are respectively inserted into the first and second terminal holes and electrically coupled to the first signal paths and second signal paths. The terminal positioning portion has a plurality of third terminal holes disposed at both sides of the first terminal holes and second terminal holes, and the grounding terminals are inserted into the third terminal holes and electrically coupled to the grounding area.

In a preferred embodiment, the gaps between the first signal paths are equal. The gaps between the second signal paths are equal. the vertical offset errors corresponding to the first signal paths and second signal paths are less than 20%

BRIEF DESCRIPTION OF THE DRAWING PORTIONS

DETAILED DESCRIPTION OF THE PREFERRED EMBODIMENT

Figure 1:
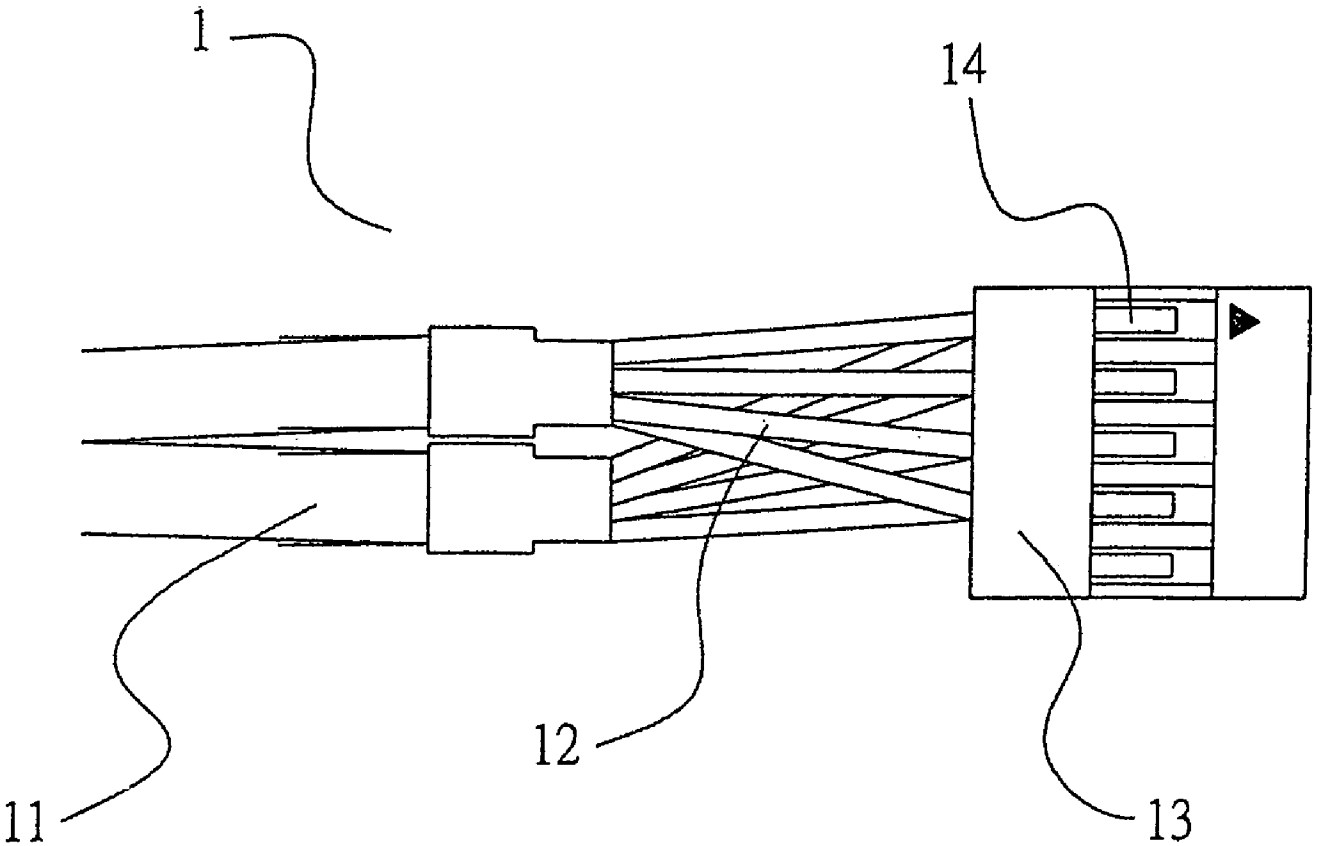
FIG. 1 PRIOR ART
FIG. 1 shows a schematic view of a connecting end of a conventional cable connector.
Figure 2:
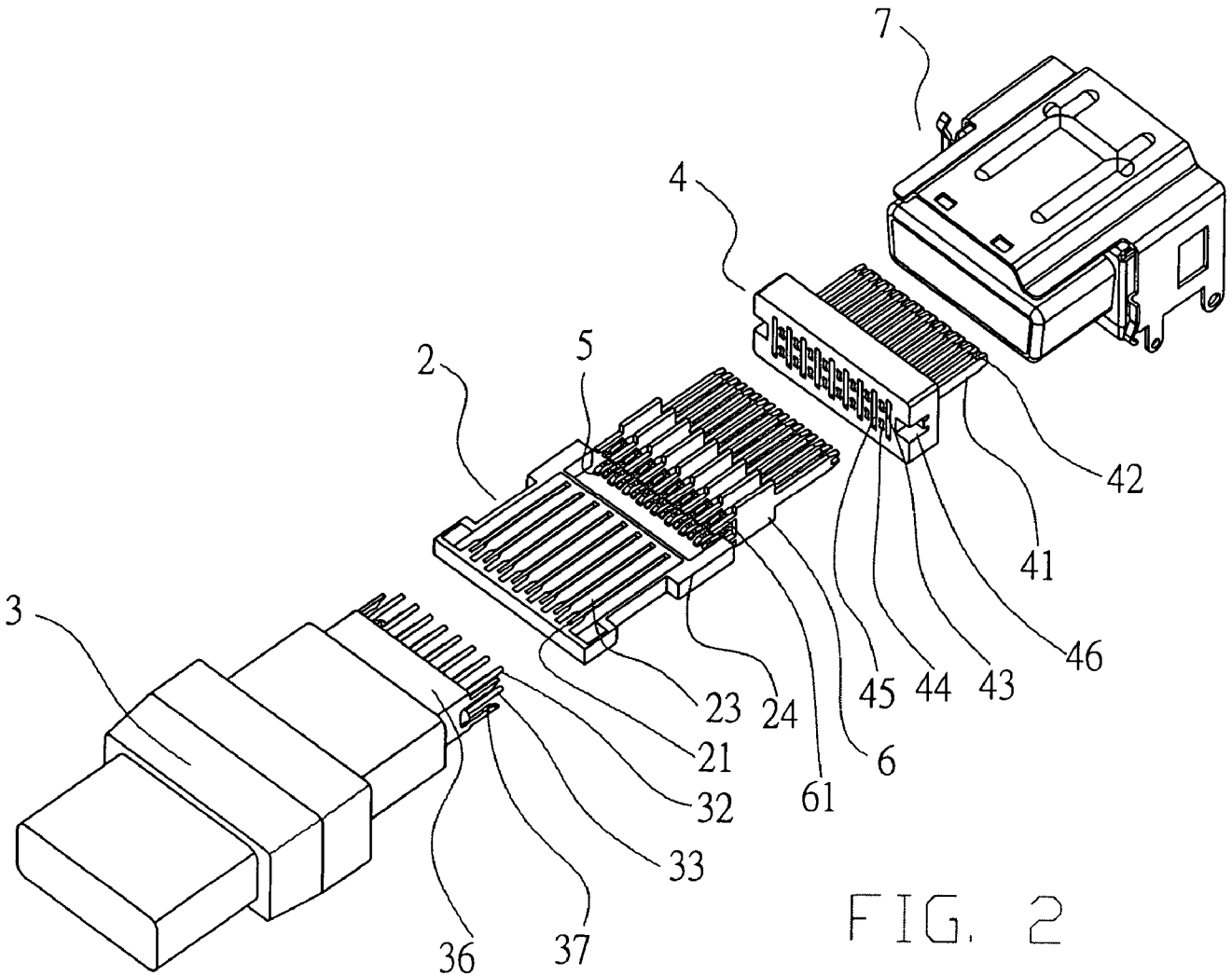
FIG. 2 shows a partial exploded view of the cable connector according to one embodiment of the present invention.
Figure 3:
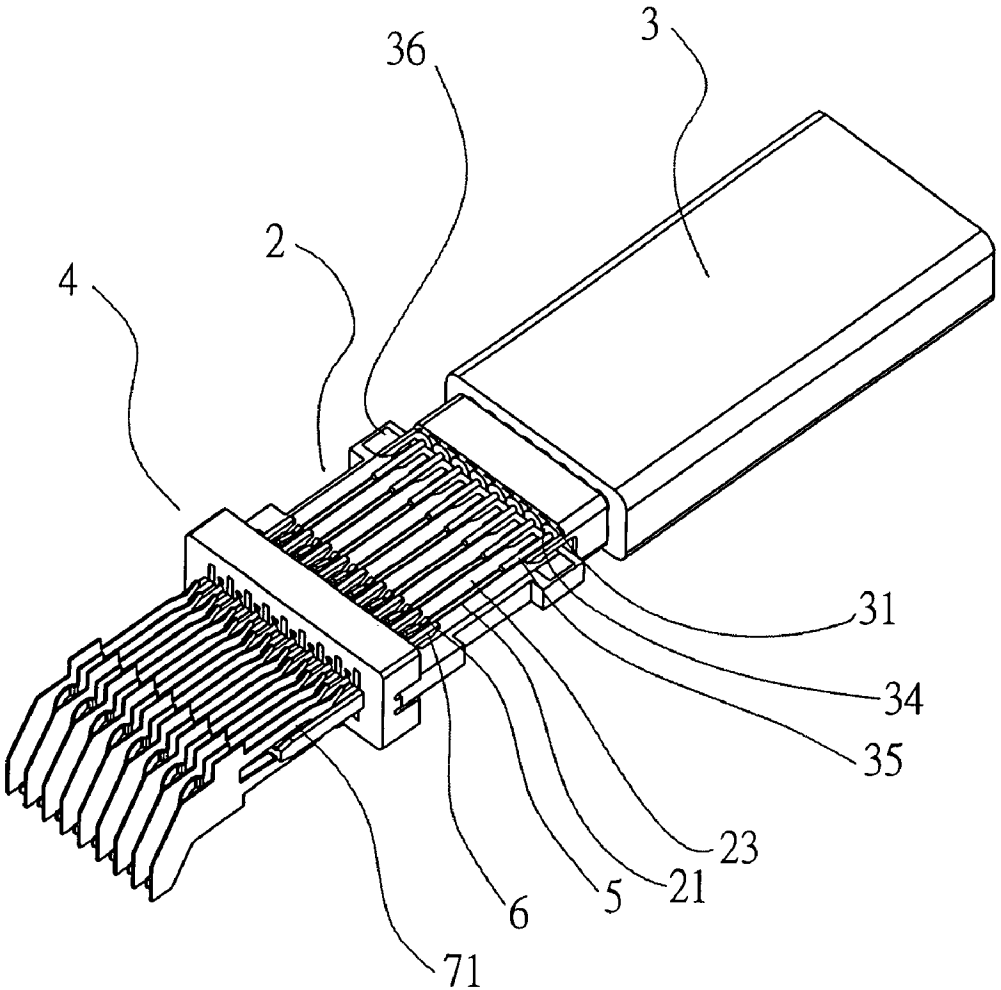
FIG. 3 shows a perspective view of the cable connector being connected with a cable according to one embodiment of the present invention.

Referring to FIGS. 2~3, which show a partial exploded view of the cable connector and a perspective view of the cable connector being connected with a cable according to one embodiment of the present invention. The cable connector of the present invention comprises: a circuit board 2 with symmetrical traces layout on both sides, a cable 3, a plurality of conductive terminal pairs 5 and grounding terminals 6, and a terminal positioning portion 4. The cable connector as shown is connected to a matching connector 7 to transmit signals.

Figure 4:
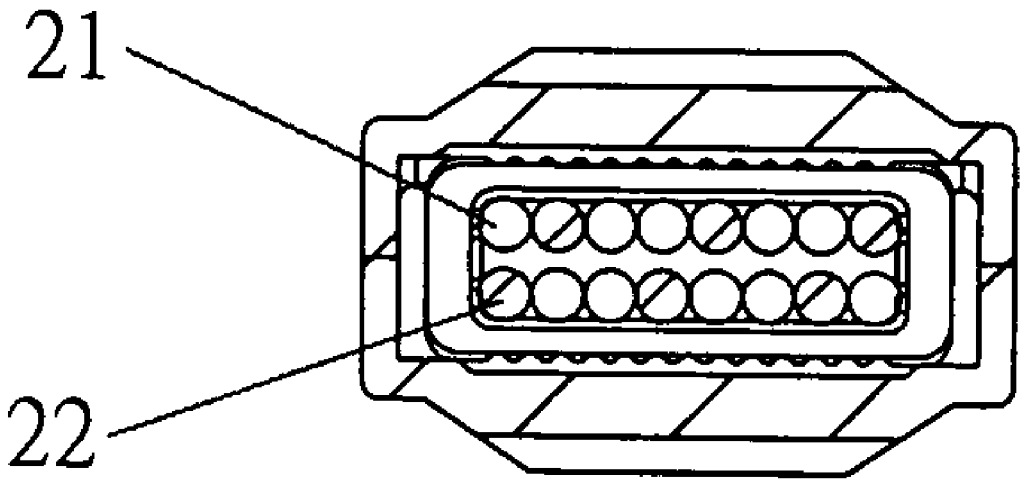
FIG. 4 shows a sectional view of the cable being connected with a cable connector according to one embodiment of the present invention.

The circuit board 2 comprises a plurality of separated conductive copper traces including a plurality of parallel first signal paths 21 and a plurality of parallel second signal paths 22 symmetrically formed on another side of the circuit board 2 (please refer to FIG. 4, which shows an embodiment with two layers). The circuit board 2 further comprises a grounding area 23 with a plurality of grounding paths extended to the portions between each two signal paths and formed separately at both sides of each signal path. The vertical offset errors corresponding to the first signal paths 21 and second signal paths 22 are less than 20% so as to maintain better matching impedance. The cable 3 has a plurality of parallel transmission channels 31. Each transmission channel 31 is formed by vertically symmetrical signal lines 32, 33. Each signal line 32, 33 comprises a conductive core 35 with an insulating medium 34 and a conductive layer sequentially covered outside. The signal lines 32, 33 of each transmission channels 31 are individually connected to the first signal paths 21 and second signal paths 22 of the circuit board 2. The cable connector further comprises a ground shielding unit 36 at the end of the cable, enclosing outside the transmission channels 31. The ground shielding unit 36 further comprises a first clipping portion 37 symmetrically disposed at both sides of the transmission channels 31, coupling and positioning to the grounding area 23 of the circuit board 2. Thus, the transmission channels 31 can be coupled to the first signal paths 21 and second signal paths 22 firmly.

The terminal positioning portion 4 has an inserting end portion 41 corresponding to the matching connector 7. The inserting end portion 41 further comprises accepting grooves 42 disposed with the same intervals to accept the conductive terminals 5 and grounding terminals 6, which can be electrically coupled to the terminals 71 of the matching connector 7 when the cable connectors are inserted therein. The terminal positioning portion 4 comprises a plurality of first terminal holes 43 and second terminal holes 44 another side of the accepting grooves 42. The conductive terminals 5 are electrically coupled to the first signal paths 21 and second signal paths of the circuit board 2 through the first terminal holes 43 and second terminal holes 44. The terminal positioning portion 4 further comprises a plurality of third terminal holes 45 disposed at both sides of the first terminal holes 43 and second terminal holes 44, and the grounding terminals 6 further comprise a second clipping portion 61. The grounding terminals 6 can be fixed on the circuit board 2 by the second clipping portion 61 and electrically coupled to the grounding area thereof after passing through the third terminal holes 45. Furthermore, the circuit board 2 comprises a wedge portion 24, and the terminal positioning portion 4 comprises a buckling groove 46 corresponding to the wedge portion 24. Thus, each conductive terminal 5 and grounding terminal 6 could be positioned to the first signal paths 21, second signal paths 22 and grounding area 23 on the circuit board 2 through the terminal positioning portion 4, sequentially.

Figure 5:
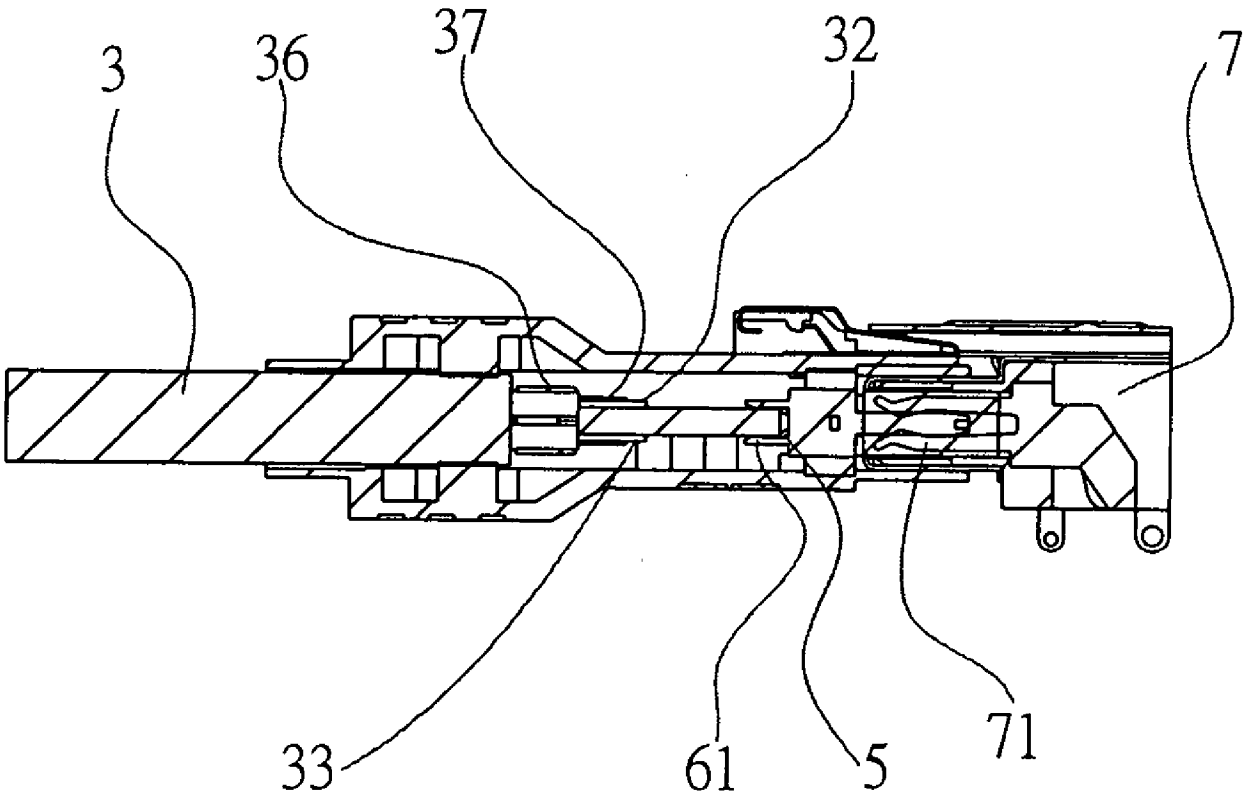
FIG. 5 shows a sectional view of the cable connector being assembled according to one embodiment of the present invention.

Referring to FIG. 5, which shows a sectional view of the cable connector being assembled according to one embodiment of the present invention. In FIG. 5, each conductive core 35 of the transmission channel 31 formed by vertically symmetrical signal line 32,33 is straight connected to the first signal paths 21 and second signal paths 22 of the circuit board 2 while assembling. The ground shielding unit 36 of cable 3 is then positioned and connected to the grounding area 23 on the circuit board 2 by the first clipping portion 37. Next, the conductive terminals 5 are straight connected to the first signal paths 21 and the second signal paths 22 on another side of the circuit board 2. The grounding terminals 6 are also positioned and connected to the grounding area 23 on the circuit board 2 by the second clipping portion 61 thereof. Thus, the cable 3 and the matching connector 7 are formed straight pitch to pitch conducting so as to get better matching impedance and best transmission efficiency.

Therefore, the present invention relates to a cable connector with better matching impedance and high transmission efficiency so as to overcome the drawbacks of the prior art electrical connector.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A cable connector comprising:

a) a circuit board having:

i) a plurality of first signal paths;

ii) a plurality of second signal paths, the plurality of first signal paths and the plurality of second signal paths are parallel; and iii) a grounding area having a plurality of grounding paths; and b) a cable having a plurality of transmission channels being parallel and a ground shielding unit, each of the plurality of transmission channels having a first and a second signal line being independent, each first signal line is connected to one of the plurality of first signal paths and each second signal line is connected to one of the plurality of second signal paths, the plurality of grounding paths extending between two signal paths of the plurality of first signal paths and the plurality of second signal paths, the ground shielding unit is electrically connected to the grounding area of the circuit board and has a first clipping portion located on opposing sides of the plurality of transmission channels and is connected to the grounding area of the circuit board.

2. The cable connector according to claim 1, further comprising:

a) a terminal positioning portion having:

i) a plurality of first holes;

ii) a plurality of second holes located below the plurality of first holes; and iii) a plurality of third holes located between the each pair of the plurality of first holes and the plurality of second holes, each of the plurality of third holes extending upwardly higher than the plurality of first holes and extending downwardly lower than the plurality of second holes;

b) a plurality of terminal pairs electrically connected to the plurality of first signal paths and the plurality of second signal paths and inserted into the plurality of first holes and the plurality of second holes, respectively; and c) a plurality of grounding terminals, each of the plurality of grounding terminals has a second clipping portion electrically connected to the grounding area of the circuit board and inserted into one of the plurality of third holes.

3. The cable connector according to claim 1, wherein the ground shielding unit is located around the plurality of first signal paths and the plurality of second signal paths.

4. The cable connector according to claim 1, wherein the plurality of first signal paths are equally spaced apart and have equal gaps located there between.

5. The cable connector according to claim 1, wherein the plurality of second signal paths are equally spaced apart and have equal gaps located there between.

6. The cable connector according to claim 1, further comprising a plurality of terminal pairs and a plurality of grounding terminals, the circuit board has the grounding area, the plurality of terminal pairs are electrically connected to the plurality of first signal paths and the plurality of second signal paths, each of the plurality of grounding terminals has a second clipping portion electrically connected to the grounding area of the circuit board.

7. The cable connector according to claim 1, wherein the vertical offset errors corresponding to the plurality of first signal paths and the plurality of second signal paths are less than 20%.

8. The cable connector according to claim 1, wherein each of the plurality of transmission channels has a conductive layer located thereon.

9. The cable connector according to claim 1, further comprising a terminal positioning portion and a plurality of terminal pairs, the terminal positioning portion having a plurality of first holes and a plurality of second holes, the plurality of terminal pairs electrically connected to the plurality of first signal paths and the plurality of second signal paths and inserted into the plurality of first holes and the plurality of second holes, respectively.

10. The cable connector according to claim 9, further a plurality of grounding terminals, the terminal positioning portion has a plurality of third terminal holes located between the each pair of the plurality of first holes and the plurality of second holes, the circuit board has the grounding area, each of the plurality of grounding terminals has a second clipping portion electrically connected to the grounding area of the circuit board and inserted into one of the plurality of third holes.

11. The cable connector according to claim 10, wherein each of the plurality of third holes extending upwardly higher than the plurality of first holes and extending downwardly lower than the plurality of second holes.

* * * * *